US011779964B2

(12) United States Patent
Kim et al.

(10) Patent No.: US 11,779,964 B2
(45) Date of Patent: Oct. 10, 2023

(54) WATER PIPE CLEANING SYSTEM USING HIGH-PRESSURE NITROGEN AND WATER PIPE CLEANING METHOD USING SAME

(71) Applicants: Byung Jun Kim, Ansan-si (KR); Youn Ja Jen, Seoul (KR)

(72) Inventors: Byung Jun Kim, Ansan-si (KR); Youn Ja Jen, Seoul (KR)

(73) Assignees: Byung Jun Kim, Ansan-si (KR); Youn Ja Jen, Seoul (KR)

( * ) Notice: Subject to any disclaimer, the term of this patent is extended or adjusted under 35 U.S.C. 154(b) by 418 days.

(21) Appl. No.: 16/464,058

(22) PCT Filed: Dec. 21, 2018

(86) PCT No.: PCT/KR2018/016528

§ 371 (c)(1),
(2) Date: May 24, 2019

(87) PCT Pub. No.: WO2020/130210

PCT Pub. Date: Jun. 25, 2020

(65) Prior Publication Data

US 2021/0046522 A1 Feb. 18, 2021

(30) Foreign Application Priority Data

Dec. 21, 2018 (KR) ..... 10-2018-0167244

(51) Int. Cl.
*B08B 9/032* (2006.01)
*F17C 13/00* (2006.01)
*F17C 7/00* (2006.01)

(52) U.S. Cl.
CPC ..... *B08B 9/0328* (2013.01); *B08B 9/0325* (2013.01); *F17C 7/00* (2013.01);
(Continued)

(58) Field of Classification Search
CPC ..... B08B 9/0325; B08B 9/0328; B08B 2209/032; F17C 2205/0142
See application file for complete search history.

(56) References Cited

U.S. PATENT DOCUMENTS 3,643,677 A * 2/1972 Begleiter ..... F17C 13/045 137/113
3,891,002 A 6/1975 Mowrer et al.
(Continued)

FOREIGN PATENT DOCUMENTS

CN 101480653 A 7/2009
CN 202467908 U 10/2012
(Continued)

OTHER PUBLICATIONS

Abstract: JP6431581, Jen, Y. et al. (Year: 2018).*

*Primary Examiner* — Marc Lorenzi
(74) *Attorney, Agent, or Firm* — NKL LAW; Jae Youn Kim

(57) ABSTRACT

A water pipe cleaning system using high-pressure nitrogen and a water pipe cleaning method using the same are provided. The water pipe cleaning system using high-pressure nitrogen includes: nitrogen pressure vessels containing high-pressure nitrogen therein; a main control unit gathering the high-pressure nitrogen from the nitrogen pressure vessels and controlling pressure of the high-pressure nitrogen; a feed piping device connected to an outlet of the main control unit and connected to an inlet of a pipe to be washed; and a discharge piping device connected to an outlet of the pipe and connected to a nitrogen discharging portion to discharge nitrogen discharged from the pipe to the outside. The main control unit is configured such that control modules are stacked on one another. Each of the control modules
(Continued)

is configured such that the nitrogen pressure vessels are connected together in parallel, and has an individual outlet.

9 Claims, 7 Drawing Sheets

(52) U.S. Cl.
CPC ..... *F17C 13/002* (2013.01); *B08B 2209/032* (2013.01); *F17C 2250/043* (2013.01)

(56) References Cited

U.S. PATENT DOCUMENTS 4,597,406 A * 7/1986 Loiseau ..... F17C 13/045 137/113
4,682,627 A * 7/1987 Cooper ..... F17C 7/00 137/572
5,660,201 A * 8/1997 Turner ..... B05B 12/04 134/169 C
7,000,629 B1 * 2/2006 Lucas, Jr. ..... F17C 13/045 137/113
2003/0111112 A1 * 6/2003 Gill ..... F17C 7/00 137/255
2009/0286673 A1 11/2009 Omoshiki et al.
2009/0293968 A1 * 12/2009 Seeber ..... F17C 13/04 137/606

FOREIGN PATENT DOCUMENTS

CN 203972412 U 12/2014
CN 109057208 A 12/2018
JP 50-151690 U 12/1975
JP 57-065299 U 4/1982
JP 05-000280 A 1/1993
JP 2918501 7/1997
JP 2003-136054 A 5/2003
JP 2005-343055 A 12/2005
JP 2008-308645 A 12/2008
JP 3157807 U 3/2010
JP 2010-099647 A 5/2010
JP 6431581 B1 * 11/2018
JP 6431581 B1 11/2018
KR 10-2014-0002105 A 1/2014
KR 10-2015-0138802 A 12/2015
KR 10-2017-0056063 A 5/2017

* cited by examiner

WATER PIPE CLEANING SYSTEM USING HIGH-PRESSURE NITROGEN AND WATER PIPE CLEANING METHOD USING SAME

TECHNICAL FIELD

The present invention relates to a pipe cleaning system. More particularly, the present invention relates to a water pipe cleaning apparatus and a water pipe cleaning method using the same, the apparatus cleaning the inside of a water pipe using high-pressure nitrogen to remove foreign substances such as scale deposited on an inner wall of the water pipe.

BACKGROUND ART

Generally, a water pipe serves as a passage for guiding and moving water to a predetermined place. A water pipe is installed in a buried manner or, mainly, in a manner embedded in the inside of a building, a floor, or a wall. When oxygen and water (moisture) in the atmosphere are introduced into a water pipe for a long period of time, an outer wall surface of the water pipe is oxidized and corroded, and various foreign substances stick to an inner wall surface of the water pipe and produce scale. Such scale is solidified after a long time, which causes narrowing of a channel of the water pipe.

As described above, as a cross-sectional area of a channel of a water pipe becomes smaller due to scale, a fluid movement is becomes unsmooth, and the water pipe does not function as designed. In severe cases, the water pipe may be damaged due to the pressure of the fluid movement.

Conventionally, there has been proposed a method of cleaning the inside of a water pipe by supplying wash water into the inside of the water pipe with strong pressure, or a method of removing scale inside a water pipe by using a compression wave together with the water pressure. Recently, a method of cleaning the inside of a water pipe by injecting compressed air with wash water is also used.

However, in such conventional techniques, the efficiency of washing a water pipe decreases as the water pipe is longer. It is impossible to supply the compressed air with a high pressure because the temperature of the compressed air increases and the compressed air expands when increasing the pressure. Thus, as the pressure of wash water injected into one end of the water pipe gradually decreases during the cleaning process, the efficiency of removing scale or the like at the opposite end of the water pipe decreases.

DISCLOSURE

Technical Problem

Accordingly, the present invention has been made keeping in mind the above problems occurring in the related art, and an objective of the present invention is to efficiently remove scale and foreign substances inside a water pipe by using high-pressure nitrogen.

Another objective of the present invention is to effectively clean the inside of a water pipe by controlling the nitrogen pressure supplied from high-pressure nitrogen vessels connected to each other in parallel.

Technical Solution

In order to accomplish the above objective, the present invention provides a water pipe cleaning system using high-pressure nitrogen, the system including: nitrogen pressure vessels containing high-pressure nitrogen therein; a main control unit gathering the high-pressure nitrogen from the nitrogen pressure vessels connected to each other in parallel and controlling pressure of the supplied high-pressure nitrogen; a feed piping device connected to an outlet of the main control unit and connected to an inlet of a pipe to be washed; and a discharge piping device connected to an outlet of the pipe to be washed and connected to a nitrogen discharging portion to discharge nitrogen discharged from the pipe to the outside. The main control unit is configured such that control modules are stacked on one another. Each of the control modules is configured such that the nitrogen pressure vessels are connected together in parallel. Each of the control modules has an individual outlet.

The control modules constituting the main control unit may include: a casing having a setting space therein; inlets provided at one side of the casing and connected to the nitrogen pressure vessels; pressure regulators connected to the inlets, measuring the pressure of the supplied high-pressure nitrogen, and regulating pressure of the nitrogen to be discharged; a main pipe where the high-pressure nitrogen is gathered, the high-pressure nitrogen being transferred from the pressure regulators connected to each other in parallel; and an outlet connected to the main pipe and supplying the gathered high-pressure nitrogen to the outside.

Pressure maintaining units may be provided between the pressure regulators and the main pipe such that pressure of the nitrogen to be discharged from an outlet connected to the main pipe is maintained constant.

An outer surface of the casing may be provided with display units connected to the pressure regulators, and the display units may display pressure in the high-pressure nitrogen vessels and pressure of the nitrogen transferred to the main pipe.

The display units may further display pressure inside the pipe.

The nitrogen discharging portion may be connected to a nitrogen dispersion device, and the nitrogen dispersion device may disperse nitrogen to be discharged to reduce the speed and noise of the discharged nitrogen.

The nitrogen dispersion device may be provided with a foreign substance collecting device to filter out foreign substances contained in the nitrogen discharged at the end.

After any one of the inlet and the outlet of the pipe exposed to an excavated part of a road is cut, any one of the feed piping device and the discharge piping device may be connected to the one of the inlet and the outlet of the pipe.

The feed piping device may be connected to an outlet of one of the control modules of the main control unit or connected to all outlets of the control modules.

The feed piping device may include: a flange fastened to the inlet of the pipe; and distribution pipes connected between the flange and the outlets.

In order to accomplish another objective, the present invention provides a water pipe cleaning method using high-pressure nitrogen, the method including: connecting a feed piping device and a discharge piping device to an inlet and an outlet of a pipe to be washed, respectively; connecting an outlet of a main control unit to the feed piping device and connecting a nitrogen discharging portion to the discharge piping device; connecting an outlet of a main control unit to the feed piping device; and allowing high-pressure nitrogen to flow into the feed piping device by control of the main control unit such that the pipe is cleaned. The main control unit is configured such that nitrogen pressure vessels containing high-pressure nitrogen therein are connected to each other in parallel, and the main control unit gathers the high-pressure nitrogen of the nitrogen pressure vessels connected together in parallel and controls pressure of the high-pressure nitrogen introduced in the main control unit, and the main control unit is configured such that control modules are stacked on one another, and each of the control modules is configured such that the nitrogen pressure vessels are connected in parallel and each of the control modules has the individual outlet.

The feed piping device may be connected to all outlets of the control modules of the main control unit.

After any one of the inlet and the outlet of the pipe is cut, any one of the feed piping device and the discharge piping device may be connected to the one of the inlet and the outlet of the pipe.

Advantageous Effects

Above-mentioned water pipe cleaning system using high-pressure nitrogen and a water pipe cleaning method using the same according to the present invention have the following effects.

According to the present invention, since the inside of a water pipe is cleaned by using high-pressure nitrogen, it is possible to improve the degree of cleaning the water pipe compared with cleaning of the water pipe with general wash water. In addition, it is possible to inject the nitrogen at a relatively high pressure compared with general wash water, thereby enabling more efficient cleaning.

In addition, nitrogen gas is inert so there is no risk of corrosion or explosion. Even when a high pressure is applied inside a water pipe, the temperature inside the water pipe does not increase and the water pipe is not inflated. Therefore, it is possible to prevent damage to the water pipe and to ensure the safety of the pipe cleaning work.

In addition, according to the present invention, a main control unit is constructed such that multiple nitrogen pressure vessels containing high-pressure nitrogen therein are connected to each other in parallel, and the main control unit controls the pressure of the nitrogen pressure vessels connected to each other in parallel. Accordingly, it is possible to obtain very high-pressure nitrogen, thereby facilitating cleaning of a long pipe effectively by using the high-pressure nitrogen.

In particular, the main control unit of the present invention is constructed such that multiple control modules are stacked on one another, and each of the control modules is constructed such that multiple nitrogen pressure vessels are connected in parallel to supply high-pressure nitrogen to independent outlets. When connecting the outlets of the control modules to one feed piping device, it is possible to generate a larger pressure, thereby improving the efficiency of cleaning the pipe.

In addition, the main control unit of the present invention is constructed such that multiple nitrogen pressure vessels are connected in parallel but are controlled individually. Therefore, it is possible to control the nitrogen pressure vessels according to the state of the nitrogen pressure vessels, whereby it is possible to prevent degradation of the cleaning efficiency and to cope flexibly under unexpected situations.

In addition, when connecting the outlets of the control modules to the one feed piping device, nitrogen can be stably supplied with a higher pressure, thereby efficiently cleaning a pipe having a long length and a large diameter. Therefore, the present invention can be applied to pipes of various specifications, and thus has high compatibility.

Furthermore, according to the present invention, the main control unit is provided with pressure maintaining units. Thus, even when unexpected high pressure is generated in a water pipe during cleaning of the water pipe, it is possible to maintain constant nitrogen pressure supplied to the water pipe, thereby preventing damage to the water pipe or to the cleaning system.

MODE FOR INVENTION

Figure 1:
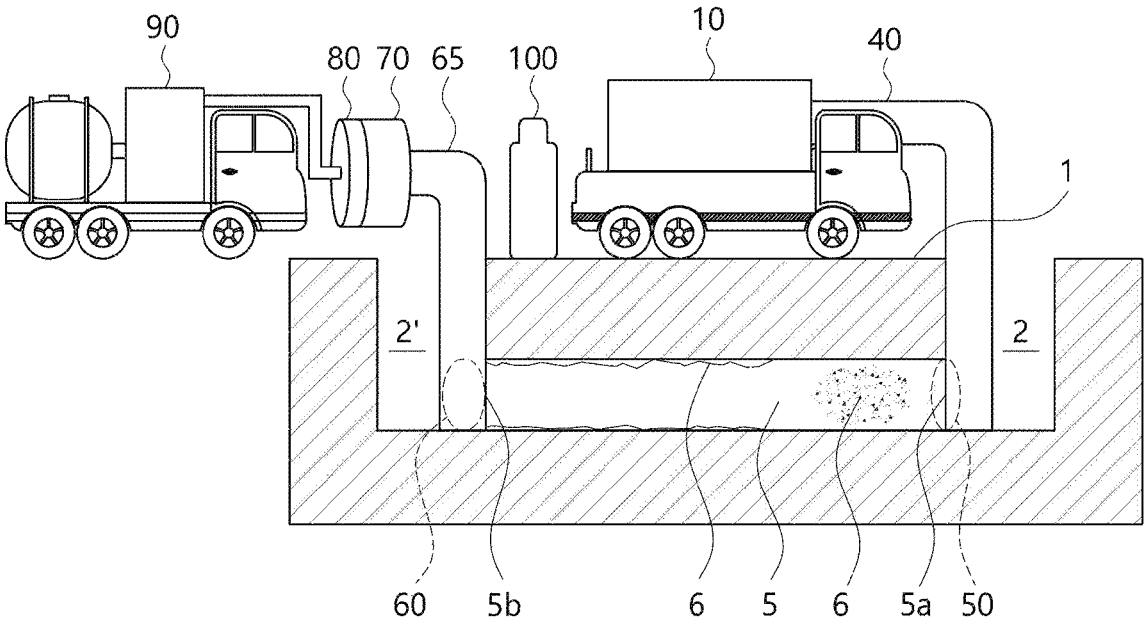
FIG. 1 is a schematic view illustrating a configuration of a water pipe cleaning system using high-pressure nitrogen according to the present invention.

Hereinafter, embodiments of the present invention will be described in detail with reference to the exemplary drawings. As for reference numerals associated with parts in the drawings, the same reference numerals will refer to the same or like parts through the drawings. In addition, in the following description, it is to be noted that, when the functions of conventional elements and the detailed description of elements related with the present invention may make the gist of the present invention unclear, a detailed description of those elements will be omitted.

A water pipe cleaning system using high-pressure nitrogen of the present invention is for cleaning the inside of a water pipe using high-pressure nitrogen. The present invention is configured such that multiple nitrogen pressure vessels 100 are connected to each other in parallel, wherein each of the nitrogen pressure vessels 100 can be controlled individually. To this end, the water pipe cleaning system of the present invention includes: multiple control modules 20; and multiple pressure regulators 25 controlling the control modules 20 elaborately. Hereinafter, a structure of the water pipe cleaning system using high-pressure nitrogen (Hereinbelow, referred to as 'water pipe cleaning system') according to the present invention will be described in detail.

As illustrated in FIG. 1, the water pipe cleaning system of the present invention is installed at a pipe inlet 5*a* and a pipe outlet 5*b* of a pipe 5 to be cleaned to control the entire process from input to discharge of nitrogen. The pipe 5 will be described in detail. Foreign substances such as scale are adhered to an inner surface of the pipe 5. The pipe inlet 5*a* and the pipe outlet 5*b* of the pipe 5 are exposed to the outside individually. In order to install the water pipe cleaning system, a part of the road is excavated so that the pipe inlet 5*a* and the pipe outlet 5*b* of the pipe 5 are exposed. The pipe inlet 5*a* is located in an inlet excavation area 2, and the pipe outlet 5*b* is located in an outlet excavation space 2'.

A feed piping device 50 and a discharge piping device 60 to be described below may be installed at the pipe inlet 5*a* and the pipe outlet 5*b* of the pipe 5 exposed to the outside.

A main control unit 10 is connected to the pipe inlet 5*a* of the pipe 5. The main control unit 10 serves to supply high-pressure nitrogen joined from the multiple nitrogen pressure vessels 100 connected to each other into the pipe 5. For reference, the nitrogen pressure vessels 100 are nitrogen vessels where nitrogen gas is stored. In the present invention, several tens to several hundred nitrogen pressure vessels 100 are connected to each other.

The main control unit 10 includes the multiple control modules 20. The multiple control modules 20 are stacked on one another to constitute one main control unit 10, wherein each of the control modules 20 is connected to the multiple nitrogen pressure vessels 100. As a result, the total number of nitrogen pressure vessels 100 that can be controlled by the main control unit 10 is determined by the number (A) of control modules 20 times the number (B) of nitrogen pressure vessels 100 connected to each control module 20.

Figure 2:
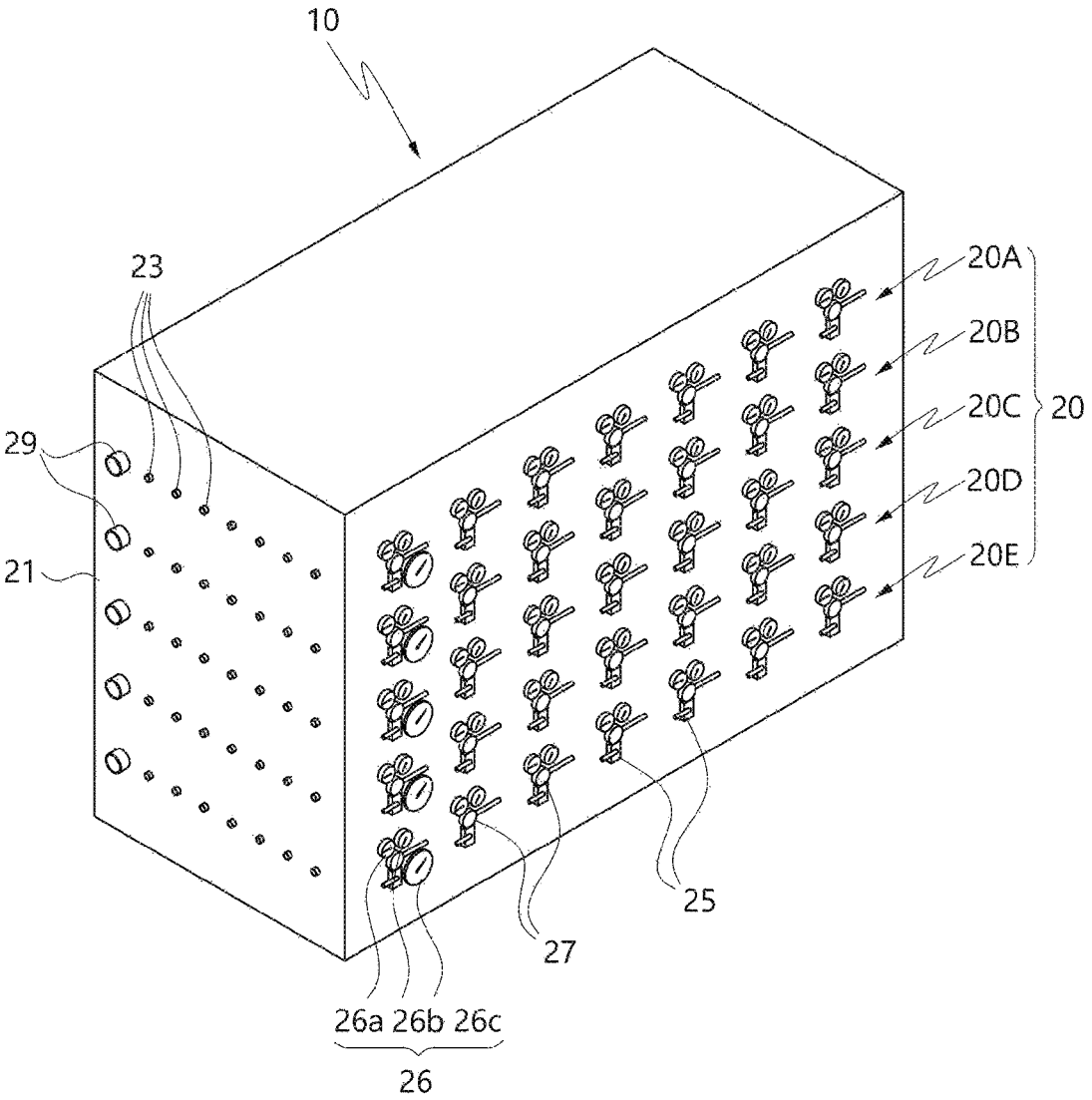
FIG. 2 is a perspective view illustrating a configuration of a main control unit constituting the water pipe cleaning system using high-pressure nitrogen according to the present invention.
Figure 3:
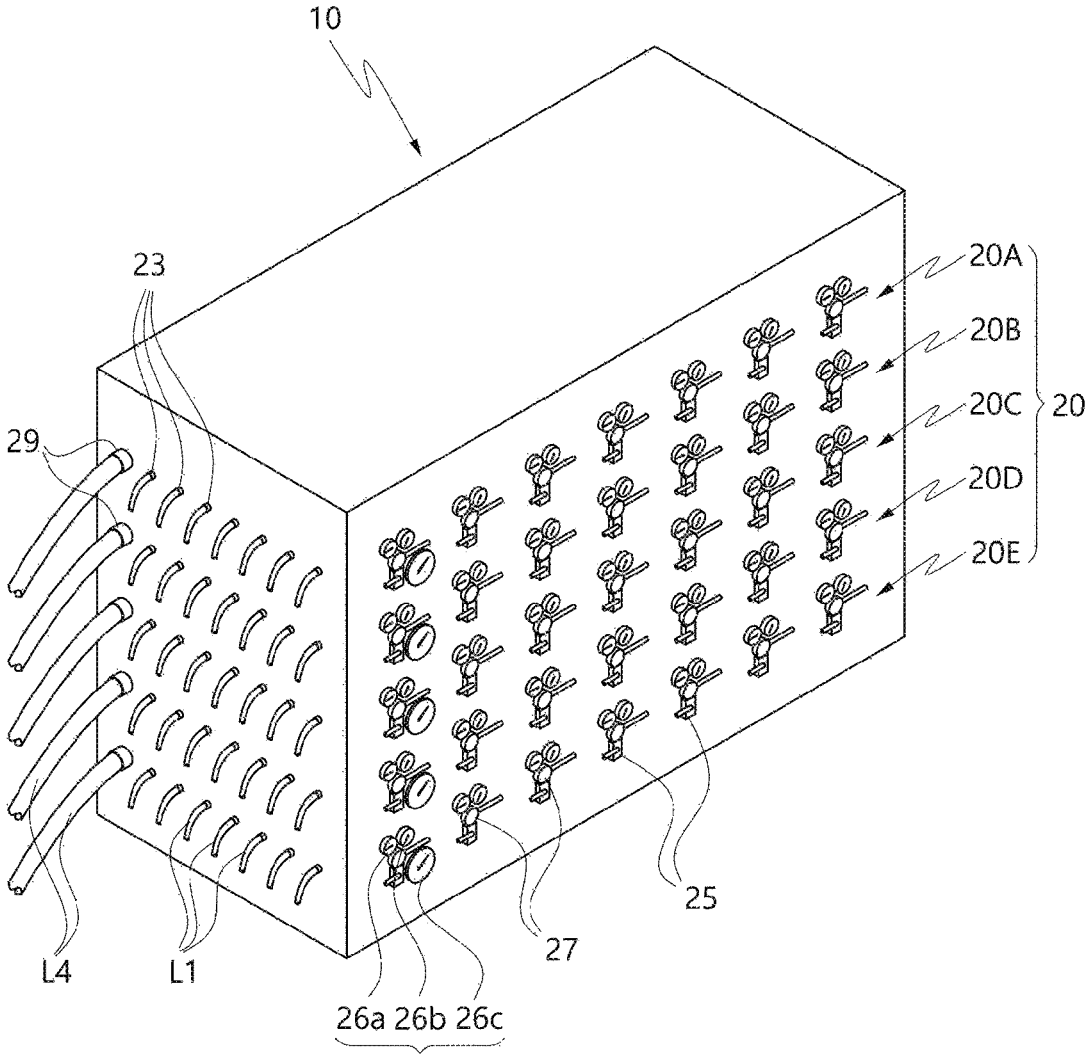
FIG. 3 is a perspective view illustrating a connection pipe connected in an embodiment of FIG. 2.

The multiple control modules 20 are constructed to be stacked on one another. Here, the multiple control modules 20 may be separable from each other or may be constructed integrally. In this embodiment, the control modules 20 are constructed in one casing 21. In this embodiment, the number of control modules 20 is five, and as illustrated in FIG. 2, different reference numerals 20A to 20E are given from the top to the bottom for convenience of explanation.

The exterior of the control modules 20 is determined by the casing 21. The casing 21 is a framework of the control modules 20. In this embodiment, the casing 21 is made of a metal and has an approximate hexahedral shape. A setting space S is defined in the casing 21. The casing 21 has inlets 23 and outlets 29 on a side surface thereof, wherein the inlets 23 and the outlets 29 are exposed to the outside to be connected with input pipes L1 and output pipes L4, respectively. Here, the input pipes L1 are connected to the nitrogen pressure vessels 100, and the output pipes L4 are connected between main pipes 38 to be described below and the feed piping device 50.

The control modules 20 are provided with the pressure regulators 25. As illustrated in FIG. 2, all or some of the pressure regulators 25 are exposed to the outside of the casing 21. Since the pressure regulators 25 are exposed to the outside of the casing 21, an operator can use the pressure regulators 25. The pressure regulators 25 are connected to each of the nitrogen pressure vessels 100 and regulate the multiple nitrogen pressure vessels 100 individually. The pressure regulators 25 are connected to the inlets 23 to measure the pressure of the supplied high-pressure nitrogen and to regulate the pressure of nitrogen to be discharged, wherein the nitrogen pressure is regulated by levers 27. The pressure regulators 25 are connected to internal input pipes L1' and pressure maintaining pipes L2 to be described below such that high-pressure nitrogen flows through the internal input pipes L1' and is discharged through the pressure maintaining pipes L2. The pressure of the nitrogen to be discharged through the pressure maintaining pipes L2 may be regulated by the levers 27 provided between the internal input pipes L1' and the pressure maintaining pipes L2.

Display units 26 connected to the pressure regulators 25 are provided on an outer surface of the casing 21. The display units 26 may be regarded as a part of the pressure regulators 25. In this embodiment, each of the display units 26 includes: a vessel pressure gauge 26*a* indicating the pressure in the nitrogen pressure vessels 100; and a supply pressure gauge 26*b* indicating the pressure of nitrogen supplied to each main pipe 38. The pressure can be measured because the pressure regulators 25 are installed between the nitrogen pressure vessels 100 and the main pipe 38 to be described below, and the supplied high-pressure nitrogen passes through the pressure regulators 25. In this embodiment, each of the display units 26 further includes a pipe pressure gauge 26*c* indicating the internal pressure of the pipe 5. Through the pipe pressure gauge 26*c*, an operator can check the state in the pipe 5 in real time.

Figure 4:
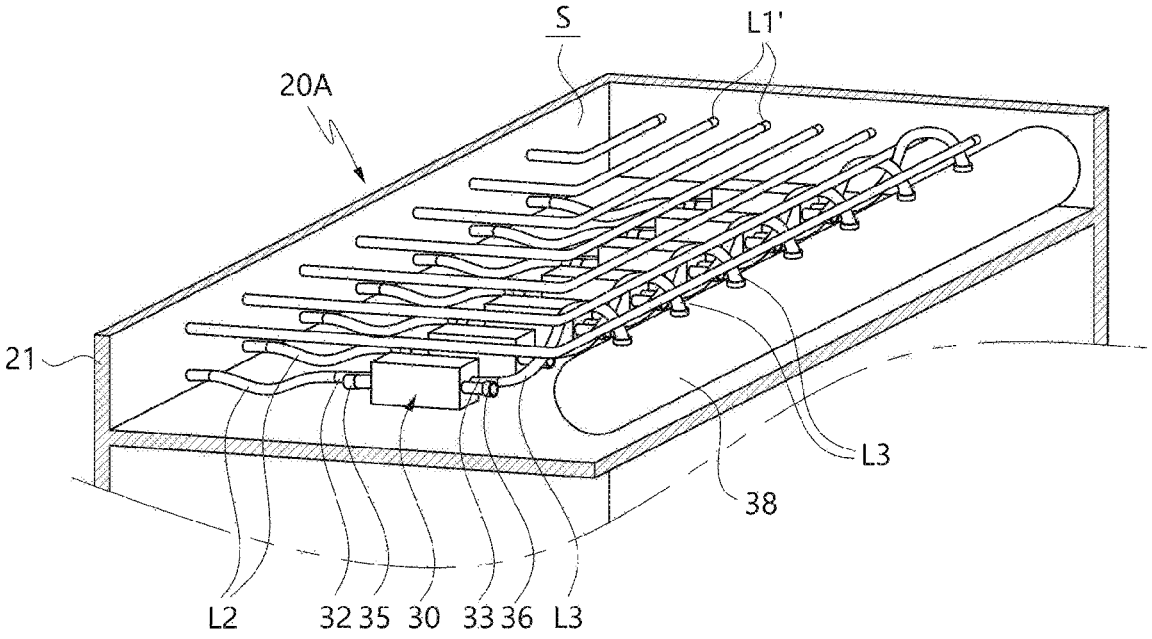
FIG. 4 is a perspective view illustrating an internal structure of the main control unit of FIG. 2.

FIG. 4 illustrates inside the casing 21. The multiple internal input pipes L1' connected to the multiple input pipes L1 are provided in the setting space S and connected to the pressure regulators 25, respectively. As a result, the input pipes L1 and the internal input pipes L1' are connected between the nitrogen pressure vessels 100 and the pressure regulators 25. Ends of the internal input pipes L1' are connected to an inner surface of the setting space S, more precisely, to a front surface of the casing 21 and connected to the pressure regulators 25.

The pressure maintaining pipes L2 are provided at positions adjacent to the internal input pipes L1'. Opposite ends of the pressure maintaining pipes L2 are connected to the pressure regulators 25 and pressure maintaining units 30, respectively. The high-pressure nitrogen gas supplied to the pressure regulators 25 through the internal input pipes L1 is discharged from the pressure regulators 25 and transferred to the pressure maintaining pipes L2. The number of pressure maintaining pipes L2 is the same as the number of input pipes L1, the number of internal input pipes L1', and also same as the number of pressure regulators 25.

Each of the pressure maintaining units 30 is connected to an end of the pressure maintaining pipe L2. The pressure maintaining units 30 are provided between the pressure regulators 25 and the main pipe 38 and maintain the pressure to be discharged from the outlets 29 connected to the main pipe 38 constant. For example, when the pressure exceeding a reference value is applied to the pressure maintaining units 30, the excess pressure is reduced by the pressure maintaining units 30. In this embodiment, the pressure maintaining units 30 maintain the pressure of about 9 kgf/cm$^2$. When the pressure higher than the pressure of about 9 kgf/cm$^2$ is supplied inside the pressure maintaining units 30, gas or fluid is discharged through pressure lowering ends 35 and 36 to lower the internal pressure and maintain the pressure at a predetermined level. Reference numerals 32 and 33 denote connection bridges connected to the pressure maintaining pipes L2 and connection bridges connected to parallel connection pipes L3, respectively.

The parallel connection pipes L3 are connected to the pressure maintaining units 30. Opposite ends of the parallel connection pipes L3 are connected to the pressure maintaining units 30 and the main pipe 38, respectively. The main pipe 38 is elongated in a longitudinal direction, and the multiple parallel connection pipes L3 are connected to the main pipe 38. Therefore, the high-pressure nitrogen gas of the multiple nitrogen pressure vessels 100 supplied through the parallel connection pipes L3 is gathered in the main pipe 38 such that the pressure is further increased. The main pipes 38 are provided one by one for each control module 20. The outlets 29 described above are connected to the main pipes 38.

The multiple control modules 20 are stacked on one another to constitute one main control unit 10. The main control unit 10 serves to discharge nitrogen gas from the nitrogen pressure vessels 100 connected to each other in parallel. In this embodiment, it is possible to individually discharge the high-pressure nitrogen gas from five output pipes by independent control of five control modules 20. The nitrogen gas is discharged to the outside through the five output pipes L4. The five output pipes L4 may be merged into one, the structure of which will be described below.

A nitrogen feeding portion 40 is connected to the main control unit 10. The nitrogen feeding portion 40 serves to allow the high-pressure nitrogen supplied through the main control unit 10 to flow into the pipe 5. The nitrogen feeding portion 40 may be connected to the output pipes L4 or constructed integrally with the output pipes L4. For example, the nitrogen feeding portion 40 may be embodied as an outer protective pipe to protect and cover the multiple output pipes L4 therein.

The feed piping device 50 is connected to an end of the nitrogen feeding portion 40. The feed piping device 50 is installed at the pipe inlet 5*a* of the pipe 5 exposed by the inlet excavation area 2 to supply the high-pressure nitrogen into the pipe 5. The feed piping device 50 allows the high-pressure nitrogen to flow inside the pipe 5 without being leaked.

Figure 5:
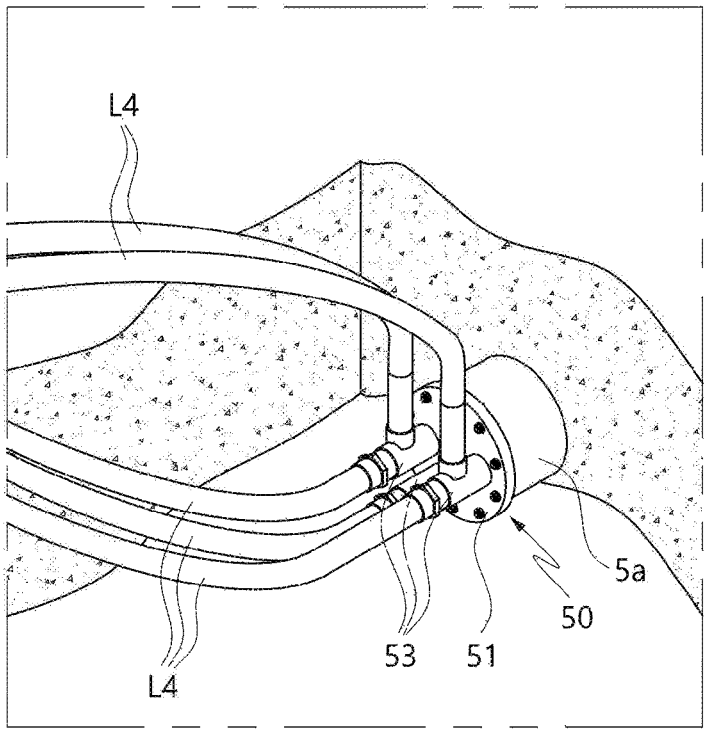
FIG. 5 is a perspective view illustrating a feed piping device connected with multiple output pipes, the feed piping device constituting the water pipe cleaning system using high-pressure nitrogen according to the present invention.

As illustrated in FIG. 5, the feed piping device 50 is connected to the multiple output pipes L4. The multiple output pipes L4 are respectively connected to the control modules 20. The feed piping device 50 may be connected to all of the multiple outlets 29 of the multiple control modules 20 as described above or may be connected to one output module 29 of one control module 20 of the main control unit 10. When there are several pipes 5 to be cleaned at the same time, the multiple outlets 29 may be connected to each pipe 5.

The feed piping device 50 includes: a flange 51 fastened to the pipe inlet 5*a* of the pipe 5; and multiple distribution pipes 53 connected between the flange 51 and the multiple outlets 29. The flange 51 is firmly fastened to the pipe inlet 5*a* of the pipe 5 by locking means and connected to the multiple distribution pipes 53. In FIG. 5, there are five distribution pipes 53. Since the output pipes L4 are fastened to the distribution pipes 53, the high-pressure nitrogen gas supplied through the multiple output pipes L4 is gathered by the feed piping device 50.

The high-pressure nitrogen gas supplied through the feed piping device 50 removes foreign substances inside the pipe 5. In the present invention, since the inside of the pipe 5 is cleaned by using high-pressure nitrogen, it is possible to improve the degree of cleaning the pipe containing high-pressure nitrogen therein compared with cleaning of the pipe with general wash water. In particular, it is possible to inject the nitrogen at a relatively high pressure, thereby enabling more efficient cleaning. Nitrogen gas is inert so there is no risk of corrosion or explosion. Even when a high pressure is applied inside the pipe, the temperature does not increase and the pipe is not inflated. Therefore, it is possible to prevent damage to the pipe 5.

Figure 6:
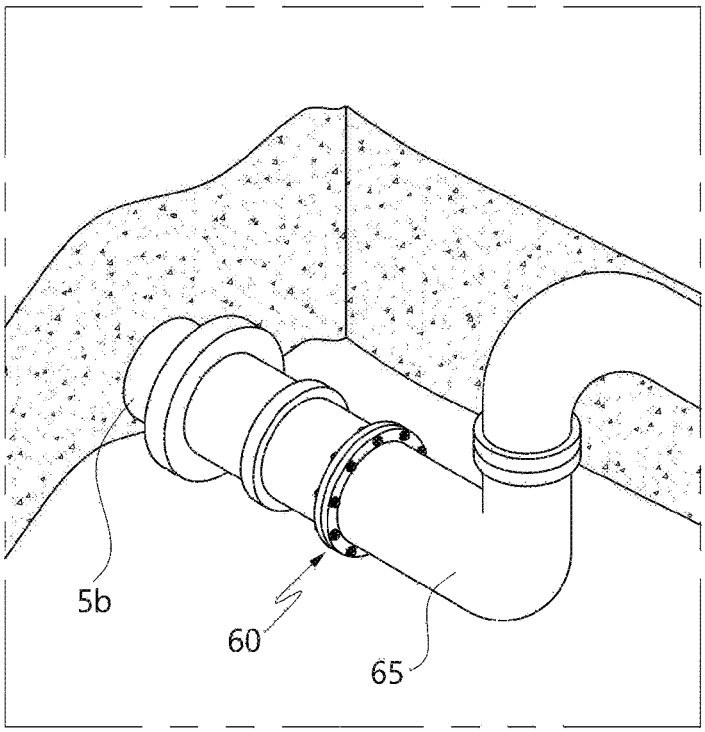
FIG. 6 is a perspective view illustrating a discharge piping device constituting the water pipe cleaning system using high-pressure nitrogen according to the present invention connected with a nitrogen discharging portion.

The high-pressure nitrogen cleaning the inside of the pipe 5 while passing therethrough is discharged to the outside through the discharge piping device 60. As illustrated in FIG. 6, the discharge piping device 60 may be embodied as a tube connected to the pipe outlet 5*b* of the pipe 5 and may be connected to the ground which is outside the excavated part. The discharge piping device 60 may be constituted with multiple parts connected to each other.

A nitrogen discharging portion 65 is connected to the discharge piping device 60. The nitrogen discharging portion 65 transfers the nitrogen gas finishing cleaning of the pipe to the outside and serves to connect the discharge piping device 60 and a nitrogen dispersion device 70. In this embodiment, the nitrogen discharging portion 65 may be regarded as an extension of the discharge piping device 60. The nitrogen discharging portion 65 is connected to the nitrogen dispersion device 70. The nitrogen dispersion device 70 disperses the nitrogen to be discharged to reduce the speed and noise of the discharged nitrogen. To this end, the nitrogen dispersion device 70 has a diameter larger than a diameter of the nitrogen discharging portion 65. A foreign substance collecting device 80 is provided in the nitrogen dispersion device 70 to filter out foreign substances contained in the nitrogen discharged at the end. The nitrogen gas having no foreign substance is transferred to a tank 90 of a gas processing transport and discharged to the outside without environmental pollution.

Figure 7:
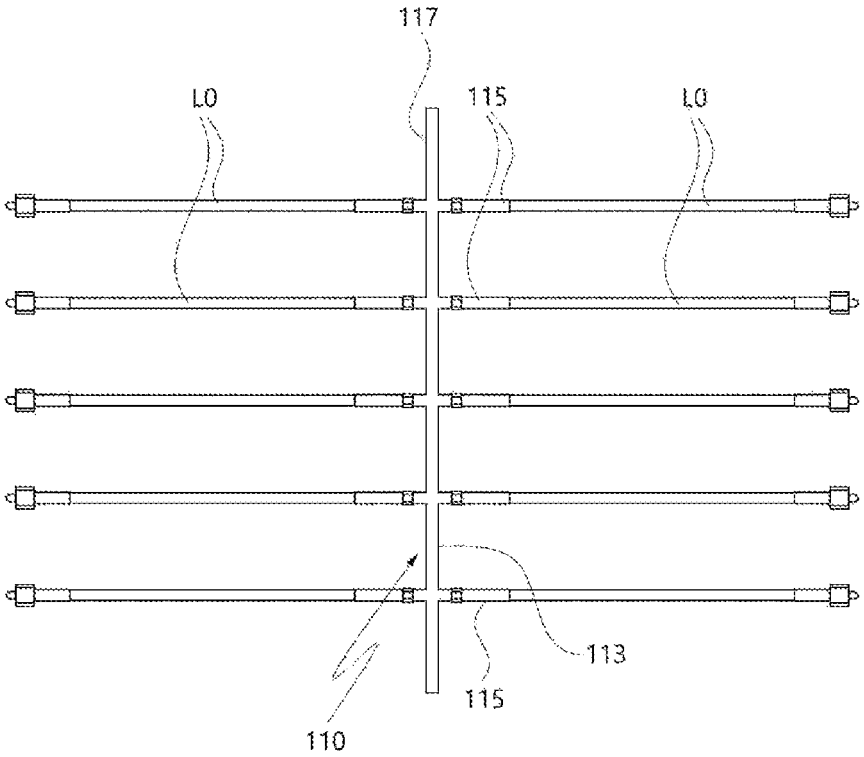
FIG. 7 is a perspective view illustrating a configuration of a pressure vessel-combining means connecting multiple nitrogen pressure vessels in parallel, the multiple nitrogen pressure vessels constituting the water pipe cleaning system using high-pressure nitrogen according to the present invention.

As illustrated in FIG. 7, the multiple nitrogen pressure vessels 100 may be connected to each other in parallel via one pressure vessel-combining means 110. That is, each of the nitrogen pressure vessels 100 may not be directly connected to the inlets 23 of the main control unit 10, but may be connected to each other in parallel via the pressure vessel-combining means 110 and then connected to the main control unit 10 in parallel. The pressure vessel-combining means 110 has multiple branches 115, wherein one nitrogen pressure vessel 100 is connected to one branch 115. The multiple branches 115 are connected to each other through a central pipe 113, and the central pipe 113 is connected to a combining output 117 of the pressure vessel-combining means 110. The combining output 117 is connected to the inlets 23 through the input pipes L1. Reference numeral L0 denotes combining pipes individually connected to the multiple nitrogen pressure vessels 100.

A water pipe cleaning method according to the present invention will be described. A part of the road is excavated to expose the pipe inlet 5*a* and the pipe outlet 5*b* of the pipe 5. The feed piping device 50 and the discharge piping device 60 are respectively installed at the pipe inlet 5*a* and the pipe outlet 5*b* of the pipe 5 exposed outside by the inlet excavation area 2 and the outlet excavation space 2'. FIGS. 5 and 6 illustrate the feed piping device 50 and the discharge piping device 60 installed at the pipe inlet 5*a* and the pipe outlet 5*b* of the pipe 5, respectively.

Next, the multiple nitrogen pressure vessels 100 are connected to the main control unit 10, and the main control unit 10 is connected to the feed piping device 50. Opposite ends of the input pipes L1 are connected to the nitrogen pressure vessels 100 and the main control unit 10, respectively, such that the multiple nitrogen pressure vessels 100 are connected to the main control unit 10 through the input pipes L1. Then, the output pipes L4 are connected to the outlets 29.

The high-pressure nitrogen gas introduced into the main control unit 10 through the input pipes is transferred to the internal input pipes L1', the pressure regulators 25, the pressure maintaining pipes L2, the pressure maintaining units 30, the parallel connection pipes L3, and the main pipes 38 in order. The high-pressure nitrogen gathered in the main pipes 38 is much increased in pressure due to the parallel connection. The high-pressure nitrogen is transferred from the main pipe 38 to the output pipes L4 and the feed piping device 50 in order and then transferred inside the pipe 5 through the pipe inlet 5*a* to perform cleaning. Finally, the nitrogen gas is discharged through the discharge piping device 60, processed in the nitrogen dispersion device 70, and then discharged to the outside. If necessary, the cleaning operation may be repeated multiple times, and the main control unit 10 may be connected to the pipe outlet 5*b* of the pipe 5 to perform the cleaning operation in the opposite direction.

The main control unit 10 is constructed such that the multiple control modules 20 are stacked on one another, and each of the control modules 20 is constructed such that the multiple nitrogen pressure vessels are connected in parallel to supply the high-pressure nitrogen to independent outlets 29. When connecting the outlets 29 of the control modules 20 to one feed piping device 50 together, it is possible to generate a larger pressure, thereby improving the efficiency of cleaning the pipe.

In this cleaning process, an operator can control the pressure of the nitrogen to be discharged by regulating the levers 27 of the pressure regulators 25. In other words, it is possible to control the discharge pressure of each nitrogen pressure vessel 100 by regulating the levers 27. Here, since the vessel pressure and the discharge pressure are displayed on the display units 26, the operator can regulate the pressure properly according to the circumstance.

The pressure regulators 25 are connected to the inlets 23 to measure the pressure of the supplied high-pressure nitrogen and to regulate the pressure of nitrogen to be discharged, wherein the nitrogen pressure is regulated by the levers 27. That is, the main control unit 10 is configured such that the multiple nitrogen pressure vessels 100 are connected in parallel but are controlled individually. Therefore, it is possible to control the nitrogen pressure vessels 100 properly according to the state of the nitrogen pressure vessels 100 whereby it is possible to prevent degradation of the cleaning efficiency and to cope flexibly under unexpected situations.

In the description above, although all of the components of the embodiments of the present invention may have been explained as assembled or operatively connected as a unit, the present invention is not intended to limit itself to such embodiments. Rather, within the objective scope of the present invention, the respective components may be selectively and operatively combined in any numbers. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof. Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Although the embodiments according to the present invention have been disclosed for illustrative purposes, those skilled in the art will appreciate that various modifications, additions and substitutions are possible, without departing from the scope and spirit of the invention as disclosed in the accompanying claims. It is thus well known to those skilled in that art that the present invention is not limited to the embodiment disclosed in the detailed description, and the patent right of the present invention should be defined by the scope and spirit of the invention as disclosed in the accompanying claims. Accordingly, it should be understood that the present invention includes various modifications, additions and substitutions without departing from the scope and spirit of the invention as disclosed in the accompanying claims.

The invention claimed is:

1. A water pipe cleaning system using pressurized nitrogen, the system comprising:

a plurality of nitrogen pressure vessels containing the pressurized nitrogen therein;

a main control unit gathering the pressurized nitrogen from the plurality of nitrogen pressure vessels connected to each other in parallel and controlling pressure of the gathered pressurized nitrogen;

wherein the main control unit comprises a plurality of control modules, wherein the plurality of control modules are respectively connected to the plurality of nitrogen pressure vessels, and the pressurized nitrogen provided from the plurality of nitrogen pressure vessels is merged with each of the plurality of control modules and discharged, and wherein each of the plurality of control modules includes:

inlets provided at one side of a casing and connected to the nitrogen pressure vessels, and pressure regulators connected to the inlets through internal input pipes provided in a setting space of the casing, measuring the pressure of the gathered pressurized nitrogen, and regulating pressure of the gathered pressurized nitrogen to be discharged;

a feed piping device connected to the main control unit and connected to an inlet of a pipe to be washed; and a discharge piping device connected to an outlet of the pipe to be washed and connected to a nitrogen discharging portion to discharge nitrogen discharged from the pipe to be washed to the outside of the casing, wherein each of the plurality of control modules includes a main pipe connected to the outlet of the pipe to be washed to supply the gathered pressurized nitrogen to the outside of the casing, wherein the main control unit is configured such that the plurality of control modules are respectively fixated one next to another in the casing, wherein each of the plurality of control modules is configured such that the plurality of nitrogen pressure vessels are connected together in parallel, wherein each of the plurality of control modules has an individual outlet, wherein a first portion of each of the plurality of the control modules is disposed in the setting space inside the casing, and a second portion of each of the plurality of the control modules is exposed outside the casing, and wherein each of the plurality of control modules is connected to the main pipe where the pressurized nitrogen is gathered, the pressurized nitrogen being transferred from each of the pressure regulators respectively connected to the inlets.

2. The system of claim 1, wherein pressure-reducing valves are provided between the pressure regulators and the main pipe such that pressure of the nitrogen to be discharged from an outlet connected to the main pipe is maintained constant.

3. The system of claim 2, wherein an outer surface of the casing is provided with display units connected to the pressure regulators, and the display units display pressure in the pressurized nitrogen vessels and pressure of the nitrogen transferred to the main pipe.

4. The system of claim 1, wherein the nitrogen discharging portion is connected to a pipe with an enlarged diameter, and the pipe with the enlarged diameter disperses nitrogen to be discharged to reduce a speed and noise of the discharged nitrogen.

5. The system of claim 4, wherein the pipe with the enlarged diameter is provided with a filter to filter out foreign substances contained in the discharged nitrogen.

6. The system of claim 1, wherein any one of the inlet and the outlet of the pipe to be washed exposed to an excavated part of a road is cut, and any one of the feed piping device and the discharge piping device is connected to the one of the inlet and the outlet of the pipe to be washed.

7. The system of claim 1, wherein the feed piping device is connected to an outlet of one of the control modules of the main control unit or connected to all outlets of the control modules.

8. The system of claim 7, wherein the feed piping device includes:

a flange fastened to the inlet of the pipe to be washed; and distribution pipes connected between the flange and the outlets of the plurality of control modules.

9. The system of claim 1, wherein the nitrogen pressure vessels are connected to each other in parallel via one pressure vessel-combining means, and a combining output of the pressure vessel-combining means is connected to the main control unit.

* * * * *